US006733358B1

(12) United States Patent
Wuest

(10) Patent No.: US 6,733,358 B1
(45) Date of Patent: May 11, 2004

(54) CAPTIVE PROPELLED MODEL

(76) Inventor: Wilmer L. Wuest, 333 N. Rivershire #240, Conroe, TX (US) 77304

( * ) Notice: Subject to any disclaimer, the term of this patent is extended or adjusted under 35 U.S.C. 154(b) by 0 days.

(21) Appl. No.: 10/675,074

(22) Filed: Sep. 30, 2003

(51) Int. Cl.[7] ..... A63H 27/04
(52) U.S. Cl. ..... 446/236; 446/396; 472/10
(58) Field of Search ..... 472/6, 7, 8, 9, 472/10, 11; 446/227, 325, 326, 396, 236; 40/411, 414, 417

(56) References Cited

U.S. PATENT DOCUMENTS

| | | | | |
|---|---|---|---|---|
| 1,593,720 A | | 7/1926 | Hanson | |
| 1,811,818 A | | 6/1931 | Parris | |
| 1,866,432 A | * | 7/1932 | Urban | 472/11 |
| 2,074,878 A | | 3/1937 | Weber | |
| 2,551,668 A | * | 5/1951 | Goosmann | 446/326 |
| 2,676,014 A | | 4/1954 | Smith | |
| 3,119,611 A | | 1/1964 | Bennett | |
| 3,383,110 A | | 5/1968 | Brown | |
| 3,546,811 A | | 12/1970 | Kupperman et al. | |
| 4,135,711 A | | 1/1979 | Holt | |
| 4,222,558 A | * | 9/1980 | Tinguely et al. | 472/11 |
| 4,543,067 A | * | 9/1985 | Wallen | 434/300 |
| 5,030,156 A | | 7/1991 | Savicki | |
| 5,146,701 A | * | 9/1992 | Lee | 40/406 |
| 5,989,098 A | | 11/1999 | Reynolds et al. | |
| 6,113,455 A | | 9/2000 | Whelan et al. | |

* cited by examiner

*Primary Examiner*—Jacob K. Ackun
(74) *Attorney, Agent, or Firm*—Raymond R. Ferrera; Arnold & Ferrera, LLP

(57) ABSTRACT

In one embodiment of the invention, a captive propelled model is provided comprising a balancing member having a pivoting pin disposed between two ends of the balancing member. A figurine having an actuator and at least one actuable member is disposed near one end of the balancing member, and a counterweight is disposed near the opposite end. A platform for the device includes wiring for connecting a power supply to the actuator. In a further embodiment of the invention, a conductive member is disposed so as to receive the pivoting pin and thereby establish an axis of rotation about which the balancing member rotates when propelled by the actuable member. The conductive surface is also in contact with a drag-line or the like that is suspended from the balancing member to establish an electrical ground for the power supply circuit. In a further embodiment of the invention, a captive propelled model further comprises a remote controller, a switch having a receiver to receive a control signal from the remote controller, and associated wiring and connections so that an operator can control the device remotely.

43 Claims, 2 Drawing Sheets

CAPTIVE PROPELLED MODEL

BACKGROUND

Sculptor Alexander Calder is often credited with creating a popular series of animated and non-animated models, some of which include the suspended moving sculpture (also called a "mobile"), a suspended stationary sculpture (or "stabile"), and a hybrid of the mobile and stabile concepts (sometimes referred to as a "standing mobile").

Except for differences in their means of suspension, these models are fundamentally similar in that they employ various pieces of artful expression, interconnected by a series of wires or thin rods. For example, a mobile has moving parts, responsive to incidental forces such as the wind, and is generally designed to hang from a rod connected to a ceiling. The parts of a stabile are usually immobile, but the device has a dynamic, three-dimensional form that suggests kinetic potential and compels physical motion from the viewer, who must circulate around the work to view it. A standing mobile generally combines a fixed base and a plurality of display members freely hanging from a balancing member.

To date, however, none of these devices has been functionally coupled with a reliable means of propulsion (for example, a propeller powered by an electromechanical, photoelectric or magnetic power supply) for propelling a captive model about a central rotational axis established by a free-standing pivoting pin disposed within a length of the balancing member even in the absence of incidental forces.

For example, U.S. Pat. No. 2,074,878 to Weber discloses a stationary support means having an arm member bolted to a shaft, wherein one end of the arm comprises a toy plane and the other end comprises a counterweight; however, no reliable means of propelling the plane about an axis established by rotation about a free standing pivoting pin disposed within a horizontal length of a balancing member is disclosed. Similarly, U.S. Pat. No. 2,676,014 to Smith discloses a hinged and latched means for rotatably supporting tan arm bearing a captive figurine, but again, no means for propelling the device about a rotational axis established by a pivoting pin disposed within the length of a balancing member is disclosed. In short, a need exists to provide a captive model with a simple and reliable means for propelling the device about an axis established by rotation around a free standing pivoting pin disposed within the length of a balancing member.

BRIEF SUMMARY OF THE INVENTION

A captive propelled model is provided comprising a balancing member having a first end and a second end, wherein the balancing member rotates around a free standing pivoting pin disposed between the first end and the second end; at least one model or figurine attached to the first end of the balancing member, wherein the figurine has at least one actuable member operating in electrical communication with an actuator; a power source in electrical communication with the actuator; and a counterweight attached to the second end of the balancing member. Also provided is a remote controlled captive propelled model that further comprises a remote control receiver and a control transmitter for controlling actuation of the actuable member.

DETAILED DESCRIPTION

Figure 1:
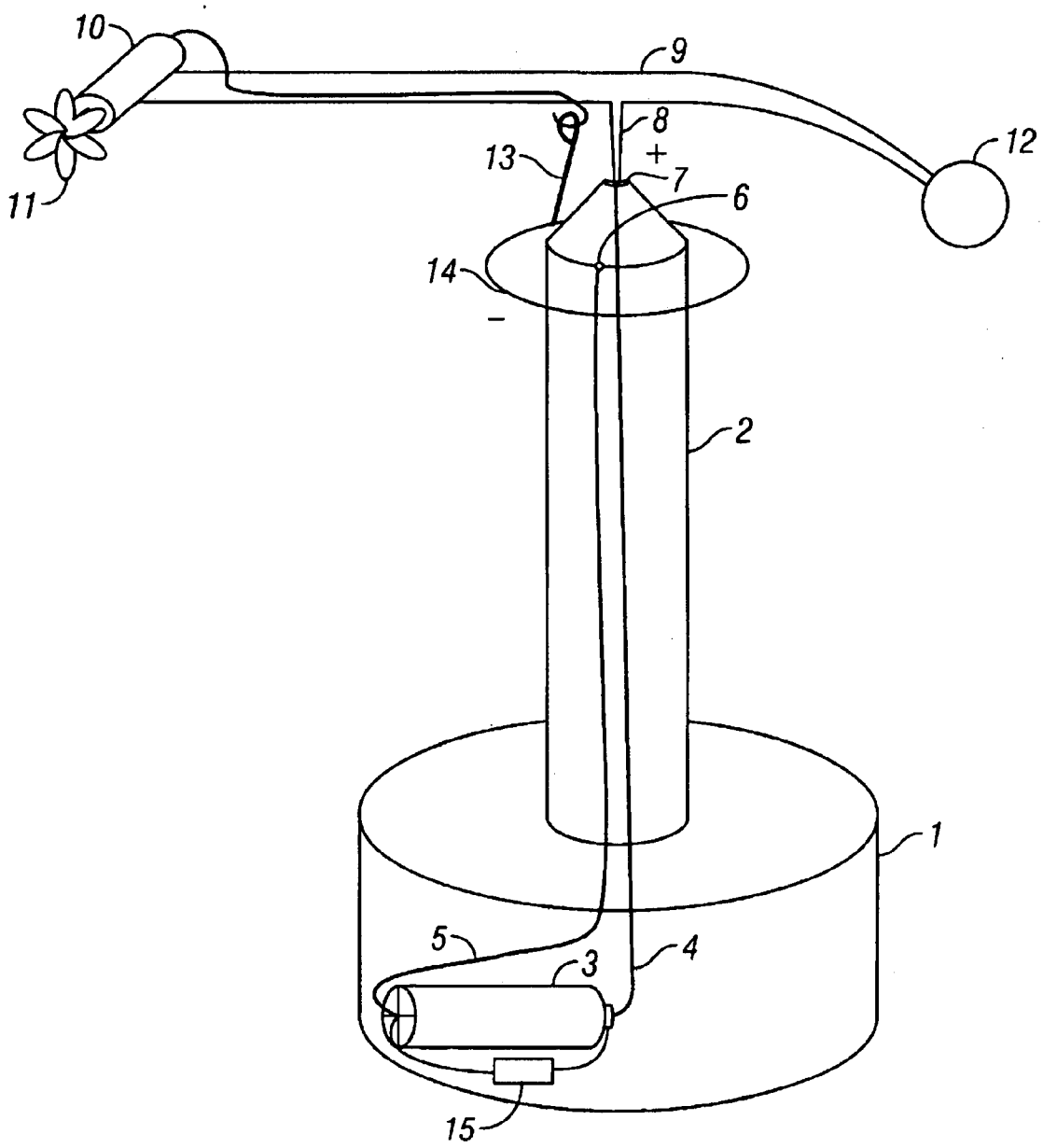
FIG. 1 is a depiction of a captive propelled model according to one aspect of the present invention.

With reference now to a specific, non-limiting embodiment of the invention depicted in FIG. 1, a captive propelled model is shown comprising a base or platform member 1; a vertical support member 2 structurally affixed to said base or platform member 1; a power source 3 disposed within a body portion of said base or platform member 1; a positive wiring connection 4 attached to a positive output of said power source 3 and arranged so as to be enclosed within a body portion of said vertical support member 2; a negative or ground wiring connection 5 attached to a negative output of said power source 3 and arranged so as to be enclosed within a body portion of said vertical support member 2; a grounding terminus 6 disposed in communication with a conductive surface 14 so as to receive said negative or ground wiring connection 5 and to effectively establish an electrical ground for the device's power circuit; a receiving member 7 for receiving current transmitted by said power source 3 along said positive or hot wiring connection 4, and for establishing a seat or receiving point for receiving a free standing pivoting pin 8 disposed in communication with a balancing member 9; at least one figurine or other model 10 that has been formed either structurally integral with or mechanically attached to one end of said balancing member 9; a propeller or other propulsive means 11 affixed to said figurine 10; a counterweight 12 disposed on an opposite end of the balancing member from which figurine 10 is disposed; and a drag line 13 disposed in communication with both said balancing member 9 and said conductive surface 14 to so as to effectively establish an electrical ground for the device's power circuit.

While the device shown in FIG. 1 discloses a presently preferred embodiment of the captive propelled model disclosed herein, those of ordinary skill in the appropriate arts will appreciate that many other variations of the invention described above could be employed without departing from the scope or spirit of the present invention. For example, while the embodiment of FIG. 1 shows what is essentially a standing mobile as modified by the propulsive means and pivoting pin of the present invention, the configuration could easily be reworked to comprise a hanging mobile, so long as a receiving member 7 is provided to receive a free standing pivoting pin 8 which supports the balancing member 8 balanced thereupon.

In other alternative embodiments, balancing member 9 is a solid metallic member, which itself carries current to the figurine 10 and/or propeller 11; in further embodiments, balancing member 9 comprises a tube shaped member with wiring disposed within to power the figurine 10 and/or propeller 11. In still further embodiments of the invention, propeller 11 is driven by a small motor connected to the power source by wiring, while in other embodiments, when the power circuit is activated, a light is turned on that shines toward a photoelectric plate disposed in electrical communication with the motor to power the propeller 11.

According to certain aspects of the invention, figurine 10 comprises an airplane having a propeller 11 disposed thereupon. In other embodiments, airplane figurine 10 has one or more additional actuable members, for example, movable wing flaps or a movable tail assembly, or a pilot having animated limbs, etc.

According to other embodiments of the invention, power source 3 further comprises a rechargeable power source, such as a rechargeable battery; in other embodiments, power source 3 comprises an electric motor or the like, or a plurality of magnets of differing charges disposed so as to induce an electric field and thereby lend current to the device's power circuit. In a further embodiment, power source 3 comprises a photoelectric plate that is responsive to either ambient or directed light in order to generate power. In yet another embodiment, power source 3 further comprises a rheostat.

According to further aspects of the invention, power source 3 operates in electrical communication with an operating switch 15, which is controlled manually by an operator. In certain embodiments of the invention, operating switch 15 is an electrical switch; in other embodiments, electrical switch 15 is a variable modulation electric switch, so that the operator selects from one of a plurality of speeds at which the balancing member 9 is propelled about a rotational axis established by free standing pivoting pin 8. In still further embodiments, operating switch 15 contains a signal receiver, for example, a radio frequency signal receiver, and is operated remotely by an operator. In still further embodiments, power source 3 is powered by wiring that extends beyond the body of platform 1 and draws power from a wall socket by means of a plug.

Figure 2:
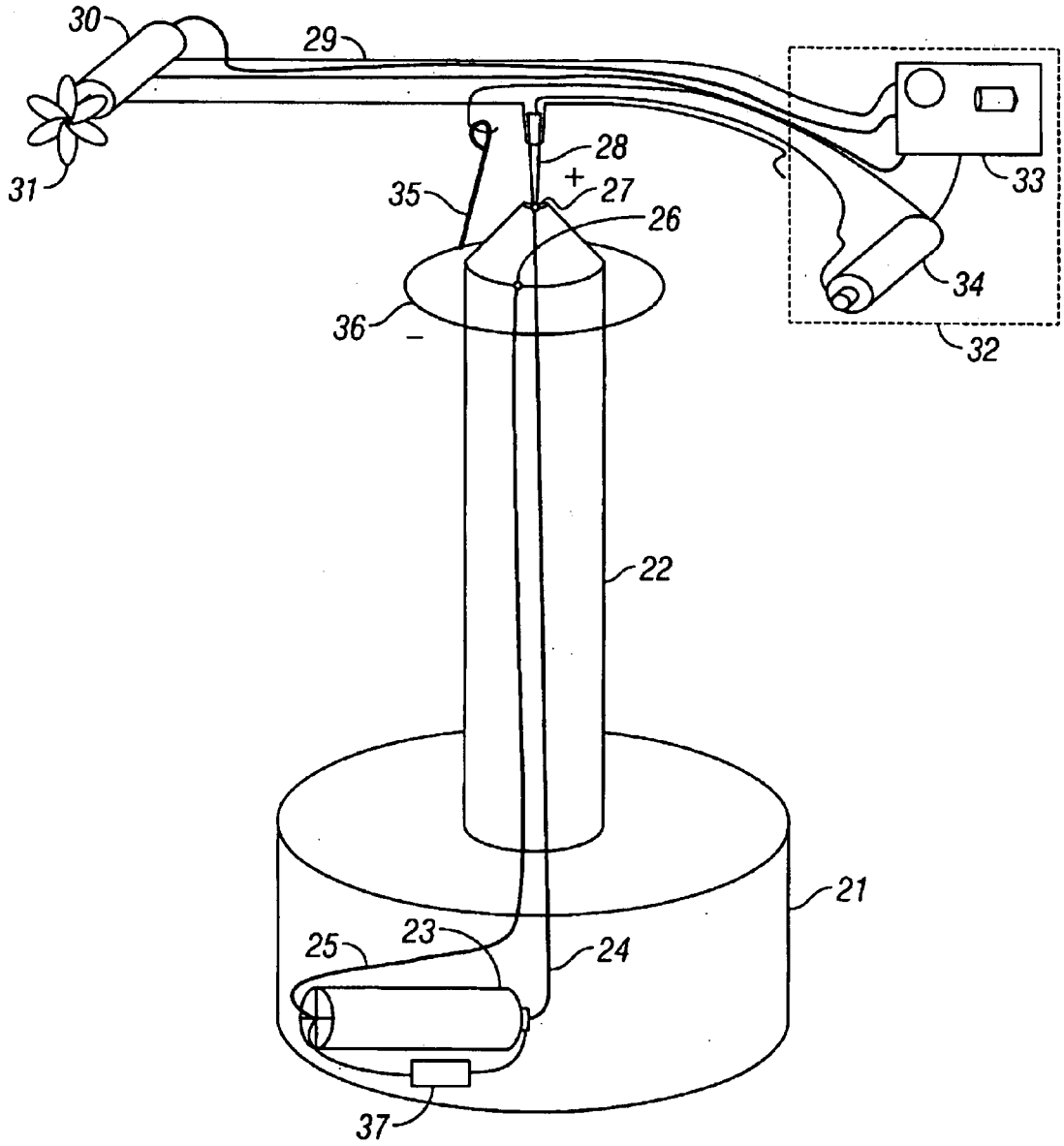
FIG. 2 is a depiction of a captive propelled model according to a further embodiment of the invention.

As seen in FIG. 2, power source 3 may be replaced or supplemented with a further power source 34 contained within said counterweight 32, which is engaged by a signal receiver/transmitter apparatus 33, for example, a radio frequency signal receiver in electrical communication with a remote controller (not shown). In the embodiment of FIG. 2, dragline 35 can be eliminated to provide a sleeker and more simply operated embodiment of the device provided a ground connection is disposed within said counterweight 32. In such an embodiment, when an operator using a remote controller sends a control signal to signal receiver/transmitter apparatus 33, power source 34 is activated so as to send current along wiring disposed within a body portion of balancing member 29, thereby activating propulsive means 31 so that the figurine 30 is propelled about an axis established by rotation of the balancing member 29 about free standing pivoting pin 28.

In an alternative embodiment, the entire balancing member 29 is removed from the receiving member 28, thereby disengaging balancing member 29 completely from the vertical support member 22, so that it may be placed upon another, external receiving member (for example, a pencil eraser or a different model's base) and still rotate about an axis established by the disposition of pivoting pin 28, which permits animation of the device with a greater simplicity and freedom of movement than would otherwise be expected from a standing mobile.

Alternatively, power source 23 may be engaged by simply activating a switch 37 so that current is delivered along wiring connections disposed within a body portion of vertical support member 22. In this embodiment, dragline 35, which is in communication with metallic balancing member 29, is employed to make contact with conductive surface 36, which also serves as a terminus point 26 for negative or ground connection 25 to ground the device's power circuit.

As seen in the embodiment of the invention depicted in FIG. 2, positive wiring connection 24 is disposed in electrical communication with metallic receiving member 27 and free standing pivoting pin 28, which is in turn disposed in electrical communication with a rechargeable power source 34 disposed within counterweight 32.

In further embodiments, a power source 34 and signal receiver/transmitter apparatus 33 are disposed in portions of the device other than within a body portion of the counterweight 32. For example, a power source and signal receiver/transmitter apparatus 33 can be disposed within a body portion of vertical support member 22, within a body portion of base or platform 21, or within a body portion of balancing member 29.

The foregoing specification is provided for illustrative purposes only, and is not intended to describe all possible aspects of the present invention. Moreover, while the invention has been shown and described in detail with respect to several exemplary embodiments, those of ordinary skill in the pertinent arts will appreciate that minor changes to the description, and various other modifications, omissions and additions may also be made without departing from either the spirit or scope thereof.

What is claimed is:

1. A captive propelled model comprising:

a balancing member having a first end and a second end, wherein said balancing member is disposed in communication with a free standing pivoting pin disposed between said first end and said second end;

at least one figurine disposed on said first end of said balancing member, wherein said figurine has at least one actuable member operating in communication with an actuator;

a counterweight disposed on said second end of said balancing member; and a power source in communication with said actuator.

2. The captive propelled model of claim 1, wherein said balancing member further comprises a solid metallic balancing member.

3. The captive propelled model of claim 1, wherein said balancing member further comprises a tube shaped balancing member.

4. The captive propelled model of claim 3, wherein said actuable member is powered by said power source by means of a wire disposed within said tube shaped balancing member.

5. The captive propelled model of claim 1, wherein said figurine further comprises an aircraft figurine having at least one actuable member disposed thereupon.

6. The captive propelled model of claim 5, wherein said at least one actuable member further comprises a propeller.

7. The captive propelled model of claim 1, wherein said at least one actuable member further comprises one or more movable portions of a figurine.

8. The captive propelled model of claim 1, wherein said power source further comprises an electric motor.

9. The captive propelled model of claim 1, wherein said power source further comprises a magnet.

10. The captive propelled model of claim 1, wherein said power source further comprises a photoelectric plate.

11. The captive propelled model of claim 1, wherein said power source further comprises a rechargeable power source.

12. The captive propelled model of claim 11, wherein said rechargeable power source comprises a battery.

13. The captive propelled model of claim 1, wherein said power source further comprises a rheostat.

14. The captive propelled model of claim 1, wherein said counterweight is formed structurally integral with said balancing member.

15. The captive propelled model of claim 1, wherein said counterweight is not formed structurally integral with said balancing member.

16. The captive propelled model of claim 1, wherein said actuator further comprises an electric switch.

17. The captive propelled model of claim 16, wherein said electric switch further comprises a variable modulation electric switch.

18. The captive propelled model of claim 1, further comprising a remote control radio frequency signal switch.

19. The captive propelled model of claim 18, wherein said remote control radio frequency signal switch is disposed either on or within said balancing member.

20. The captive propelled model of claim 18, further comprising a control transmitter, wherein said control transmitter transmits a control signal to said actuator.

21. The captive propelled model of claim 20, wherein said control transmitter transmits a control signal for controlling actuation of said actuable member.

22. A captive propelled model comprising:

a balancing member having a first end and a second end, wherein said balancing member is disposed in communication with a free standing pivoting pin disposed between said first end and said second end;

at least one figurine attached to said first end of said balancing member, wherein said at least one figurine has at least one actuable member operating in communication with an actuator;

a counterweight attached to said second end of said balancing member;

a power source in communication with said actuator; and a conductive surface for making conductive contact with a metallic drag line, wherein said metallic drag line is disposed in communication with said balancing member so as to facilitate contact with said conductive surface.

23. The captive propelled model of claim 22, wherein said balancing member further comprises a solid metallic balancing member.

24. The captive propelled model of claim 22, wherein said balancing member further comprises a tube shaped balancing member.

25. The captive propelled model of claim 24, wherein said actuable member is powered by said power source via a wire disposed within said tube shaped balancing member.

26. The captive propelled model of claim 22, wherein said figurine comprises an aircraft figurine having at least one actuable member disposed thereupon.

27. The captive propelled model of claim 26, wherein said at least one actuable member further comprises a propeller.

28. The captive propelled model of claim 27, wherein said least one actuable member further comprises one or more movable portions of a figurine.

29. The captive propelled model of claim 22, wherein said power source further comprises an electric motor.

30. The captive propelled model of claim 22, wherein said power source further comprises a magnet.

31. The captive propelled model of claim 22, wherein said power source further comprises a photoelectric plate.

32. The captive propelled model of claim 22, wherein said power source further comprises a rechargeable power source.

33. The captive propelled model of claim 22, wherein said rechargeable power source further comprises a battery.

34. The captive propelled model of claim 22, wherein said power source further comprises a rheostat.

35. The captive propelled model of claim 22, wherein said counterweight is formed structurally integral with said balancing member.

36. The captive propelled model of claim 22, wherein said counterweight is not formed structurally integral with said balancing member.

37. The captive propelled model of claim 22, wherein said actuator comprises an electric switch.

38. The captive propelled model of claim 37, wherein said electric switch further comprises a variable modulation electric switch.

39. The captive propelled model of claim 22, further comprising a remote control radio frequency signal switch.

40. The captive propelled model of claim 39, wherein said remote control radio frequency signal switch is disposed within a body portion of said platform.

41. The captive propelled model of claim 39, wherein said remote control radio frequency signal switch is disposed either on or within said balancing member.

42. The captive propelled model of claim 39, further comprising a control transmitter, wherein said control transmitter transmits a control signal to said actuator.

43. The captive propelled model of claim 42, wherein said control transmitter transmits a control signal for controlling actuation of said actuable member.

* * * * *